United States Patent [19]

Kassai

[11] Patent Number: 4,483,026

[45] Date of Patent: Nov. 20, 1984

[54] CRIB

[75] Inventor: Kenzou Kassai, Higashishimizu, Japan

[73] Assignee: Kassai Kabushikikaisha, Osaka, Japan

[21] Appl. No.: 401,546

[22] Filed: Jul. 26, 1982

[30] Foreign Application Priority Data

Oct. 28, 1981 [JP] Japan ..... 56-173294
Oct. 28, 1981 [JP] Japan ..... 56-173295

[51] Int. Cl.[3] ..... A47D 7/00
[52] U.S. Cl. ..... 5/99 R; 5/99 B
[58] Field of Search ..... 5/99 R, 99 A, 99 B, 5/99 C

[56] References Cited

U.S. PATENT DOCUMENTS

| | | | |
|---|---|---|---|
| 1,122,284 | 12/1914 | Kyle | 5/99 R |
| 2,205,452 | 6/1940 | Wright | 5/99 C |
| 2,901,755 | 9/1959 | Wood | 5/99 R |
| 3,195,152 | 7/1965 | Gottlieb | 5/99 R |
| 3,339,213 | 9/1967 | Spencer | 5/99 R |
| 3,574,872 | 4/1971 | Mattila | 5/99 R |
| 3,631,548 | 1/1972 | Dahab | 5/99 R |
| 3,789,439 | 2/1974 | Berg et al. | 5/99 C |

FOREIGN PATENT DOCUMENTS

| | | | |
|---|---|---|---|
| 873055 | 6/1971 | Canada | 5/99 R |
| 961487 | 4/1957 | Fed. Rep. of Germany | 5/99 |
| 2747868 | 5/1979 | Fed. Rep. of Germany | 5/99 C |
| 54-2833 | 2/1979 | Japan . | |
| 54-2836 | 2/1979 | Japan . | |
| 54-15799 | 6/1979 | Japan . | |
| 54-15801 | 6/1979 | Japan . | |
| 54-40279 | 11/1979 | Japan . | |
| 55-109462 | 7/1980 | Japan . | |
| 56-54816 | 5/1981 | Japan . | |
| 2061099 | 5/1981 | United Kingdom . | |

*Primary Examiner*—Alexander Grosz
*Assistant Examiner*—Vinh Luong
*Attorney, Agent, or Firm*—Browdy & Neimark

[57] ABSTRACT

A collapsible crib has a framework substantially in the form of a rectangular parallelepiped including front and rear upper and lower rods which are foldable at their substantially central portions. Connecting bars which cross each other in a crisscross relation are pivotably mounted at ends on distal ends of the lower rods. Links are pivotably connected between the other ends of the connecting bars and side rod portions of front and rear frames of the crib framework. When the crib is unfolded or while it is being collapsed, the links are held substantially parallel to side rod portions of the lower rods. One of the upper rods of the framework may be mounted on swing rods so as to be angularly movable outwardly and downwardly, or may be mounted on slidable brackets on the side rod portions of the front and rear frames so as to be slidable downwardly for allowing the baby to be taken into or out of the crib.

11 Claims, 20 Drawing Figures

CRIB

BACKGROUND OF THE INVENTION

1. Field of the invention

The present invention relates to a crib which is easily foldable or collapsible for storage and is rugged in framework construction when unfolded for use.

2. Description of the Prior Art

There are known various collapsible cribs that can be folded when not in use for storage in a smaller space. Such foldable cribs are disclosed in Japanese Utility Model Laid-Open Publications Nos. 55-109462 and 56-54816, and Japanese Utility Model Publications Nos. 54-15801, 54-2833, 54-2836, 54-40279, 54-15799 and 54-24809, for example.

The collapsible cribs, including those described in the above publications, are generally weak in framework construction when they are unfolded because of the structure required to make the crib foldable. Attempts to render the overall framework stronger have resulted in a complex and tedious procedure to fold the crib for storage.

SUMMARY OF THE INVENTION

A crib having a framework substantially in the form of a rectangular parallelepiped includes lower rods mounted on front and rear frames and having side rod portions, and links extending below the lower rods and pivotably connected between brackets mounted on lower end portions of side rod portions of the front and rear frames and connecting bars of a crisscross configuration pivotably mounted on the side rod portions of the lower rods, the lower rods and links extending substantially parallel to each other when the crib is unfolded or being collapsed. With this construction, the crib framework is of a rugged construction and can easily and smoothly be folded in a simple operation.

It is a major object of the present invention to provide a crib having a framework which can be foldable substantially at its longitudinally central position, is of a rugged construction during use, and can be collapsed easily and smoothly for storage.

Another object of the present invention is to provide a crib having upper rods angularly movably mounted by swing rods on side rod portions of front and rear frames for angular downward and outward displacement to facilitate placing of the baby into or out of the crib.

Still another object of the present invention is to provide a crib having upper rods pivotably and slidably mouted on side rod portions of front and rear frames for downward sliding movement therealong so that the baby can be taken into or out of the crib in a simple operation.

The above and other objects, features and advantages of the present invention will become more apparent from the following description when taken in conjunction with the accompanying drawings in which certain preferred embodiments are shown by way of illustrative example.

DESCRIPTION OF THE PREFERRED EMBODIMENTS

Figure 1:
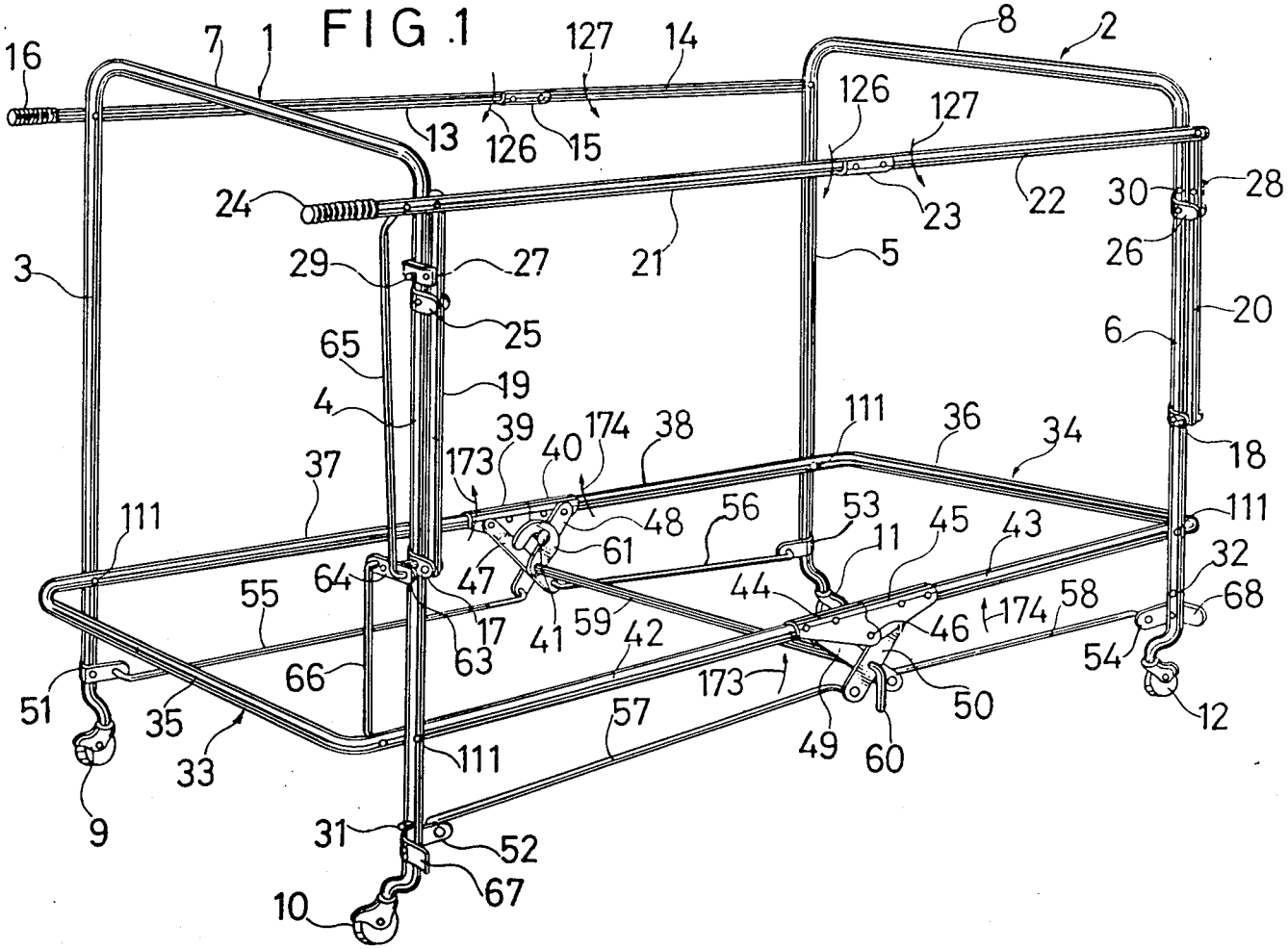
FIG. 1 is a perspective view of a crib according to a first embodiment of the present invention.
Figure 2:
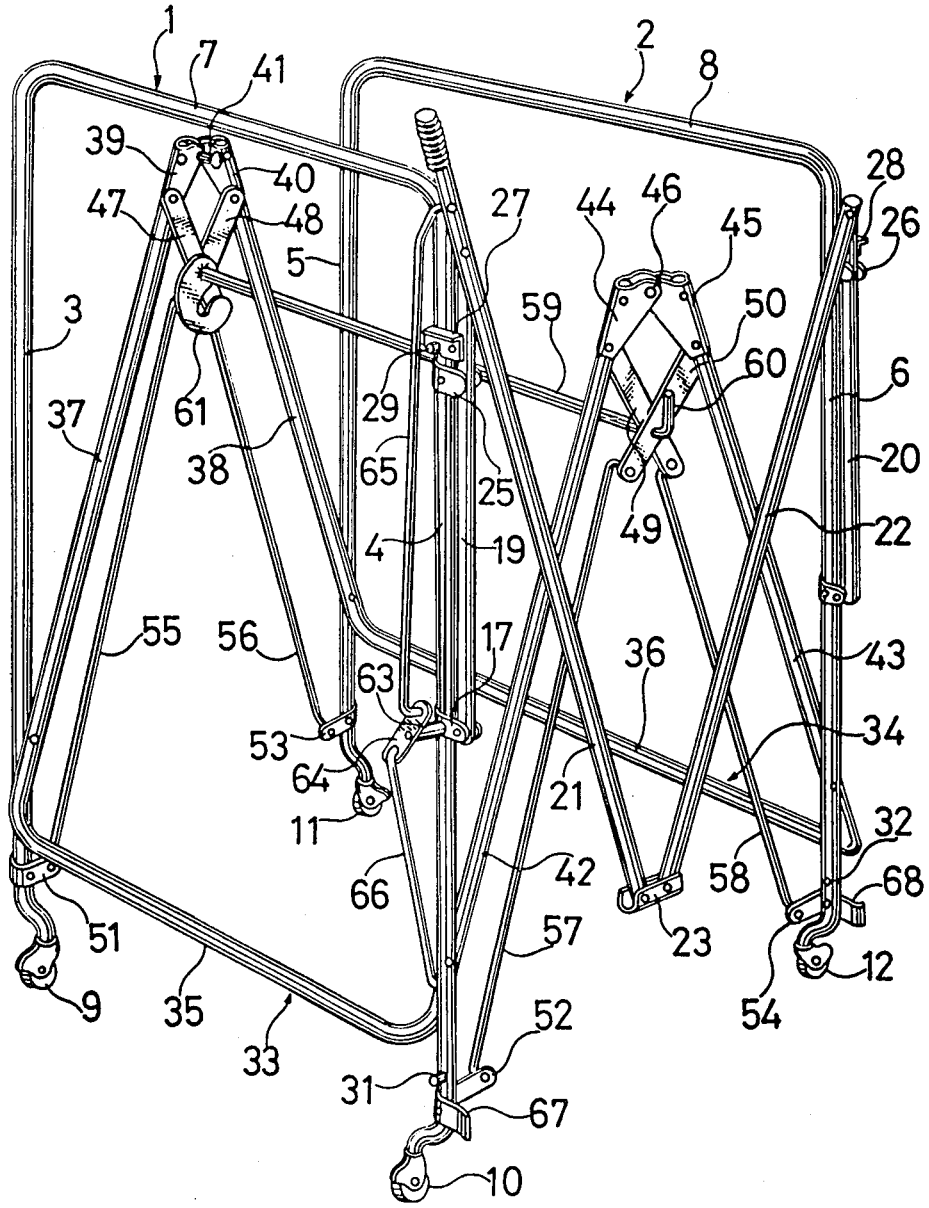
FIG. 2 is a perspective view of the crib shown in FIG. 1 as it is collapsed.
Figure 3:
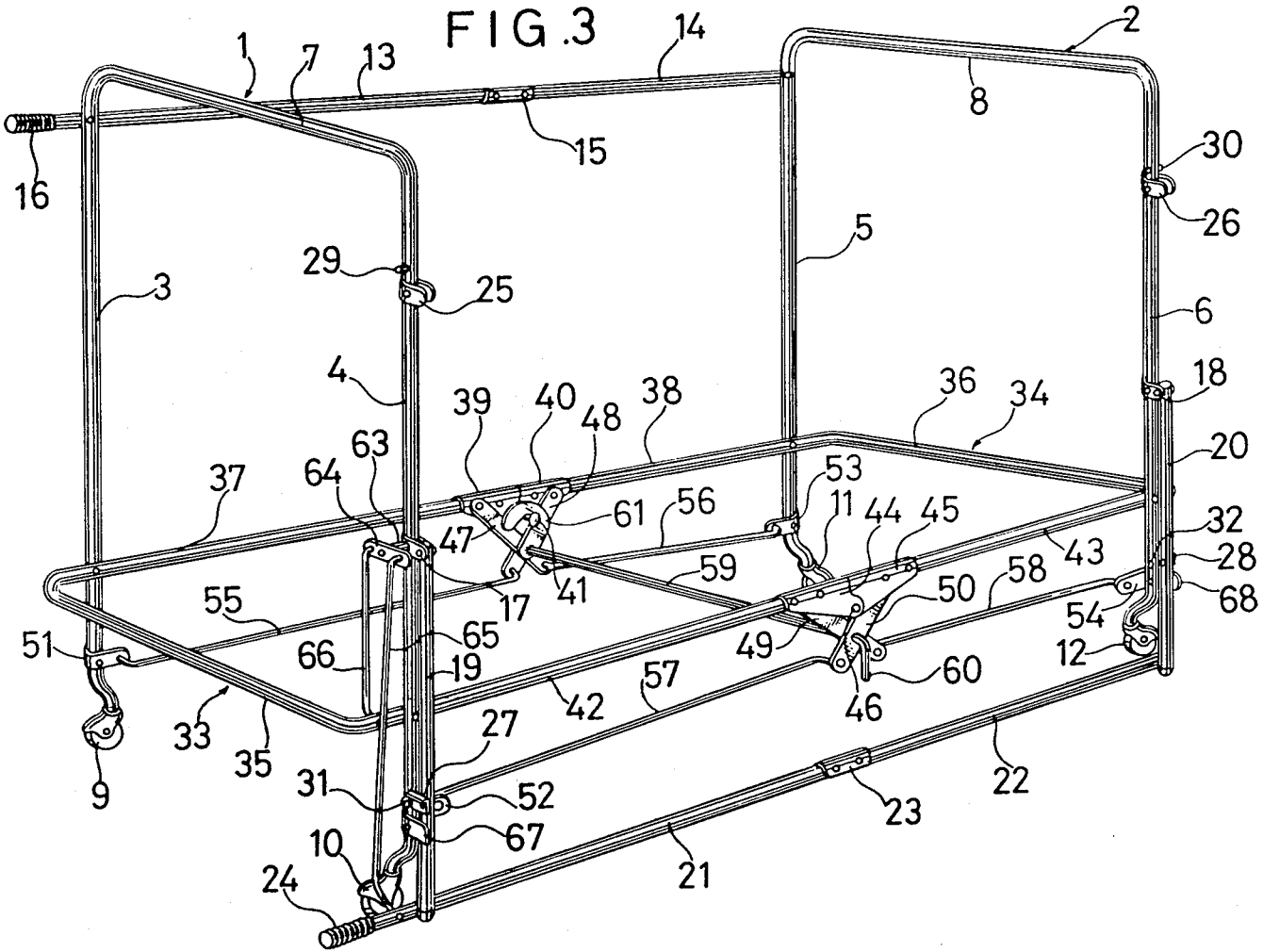
FIG. 3 is a perspective of the the crib of FIG. 1 with swing rods brought to a lower position.

FIGS. 1 through 3 illustrate a crib constructed in accordance with a first embodiment of the present invention. The crib comprises a pair of front and rear frames 1, 2 of an inverted U-shaped configuration which include laterally spaced vertical side rods 3, 4 and 5, 6, respectively, and upper horizontal rods 7, 8, respectively. The vertical side rods 3, 4, 5 and 6 have casters 9, 10, 11 and 12, respectively, mounted on their lower ends. A pair of first and second upper pivot rods 13, 14 are angularly movably mounted on the vertical rods 3, 5, respectively, at their upper end portions, the pivot rods 13, 14 being interconnected by a bracket 15 for mutual pivotal downward movement. One end of the first upper pivot rod 13 projects outwardly beyond the front frame 1 and has a plastic grip 16 mounted thereon.

The other vertical side rods 4, 6 have a pair of central brackets 17, 18, respectively, secured thereto. A pair of front and rear swing rods 19, 20 are pivotably attached at their lower ends (as shown in FIG. 1) to the brackets, 17, 18, respectively. The other ends of the front and rear swing rods 19, 20 pivotally support a pair of third and fourth pivot rods 21, 22, respectively, which are interconnected by a bracket 23 and mutually angularly movable downwardly. The third pivot rod 21 has one end remote from the bracket 23 and projecting outwardly beyond the front frame 1 with a plastic grip 24 being mounted on the projecting end of the third pivot rod 21.

The side rods 4, 6 have a pair of upper retainer guides 25, 26, respectively, for retaining the swing rods 19, 20. The swing rods 19, 20 have a pair of latch bars 27, 28, respectively, swingably mounted thereon and engageable with a pair of pins 29, 30, respectively, fixed to the respective side rods 4, 6. The side rods 4, 6 also have a pair of respective pins 31, 32 disposed adjacent to their lower ends for locking engagement with the latch bars 27, 28, respectively, when the swing rods 19, 20 are swung downwardly from the position of FIG. 1 to the position of FIG. 3.

A pair of U-shaped front and rear lower rods 33, 34 are pivotably connected by pins 111 to lower end portions of the side rods 3–6 of the front and rear frames 1, 2, respectively, the lower rods 33, 34 including central rod portions 35, 36, respectively, projecting outwardly beyond the front and rear frames 1, 2. The front and rear lower rods 33, 34 also include a pair of side rod portions 37, 38 having a pair of respective first and second brackets 39, 40 affixed to their distal ends and interconnected by a pivot pin 41 for mutual angular movement. Likewise, the front and rear lower rods 33, 34 include a pair of side rod portions 42, 43 having a pair of respective third and fourth brackets 44, 45 affixed to their distal ends and interconnected by a pivot pin 46 for mutual angular movement. First through fourth connecting rods or bars 47, 48, 49 and 50 are pivotably connected at one end thereof to inner surfaces of the first through fourth brackets 39, 40, 44 and 45, respectively.

The side rods 3, 4, 5 and 6 of the front and rear frames 1, 2 have brackets 51, 52, 53 and 54, respectively, secured to their lower end portions. The bracket 51 and the other end of second connecting rod 48 are operatively interconnected by a first link 55. Likewise, the bracket 53 is operatively connected by a second link 56 to the other end of the first connecting rod 47. Third and fourth links 57, 58 operatively interconnect the brackets 52, 54 to the other ends of the fourth and third connecting rods 50, 49, respectively.

A pivot rod 59 extends centrally across the U-shaped lower rods 33, 34 and has ends passing through the first and second connecting rods 47, 48 where they intersect and through the third and fourth connecting rods 49, 50 where they intersect. As shown in FIGS. 1 and 2, one end of the pivot rod 59 projects outwardly through the third and fourth connecting rods 49, 50 and is bent downwardly. A pair of lock knobs 61 (only one shown) are welded to the pivot rod 59 at positions just inside of the first and second connecting rods 47, 48 and the third and fourth connecting rods 49, 50. The lock knobs 61 are lockingly engageable with the pivot pins 41, 46, respectively, by which the first and second brackets 39, 40 and the third and fourth brackets 44, 46 are respectively interconnected. One of such lock knobs 61 may however be dispensed with.

The bracket 17 is affixed to the side rod 4 of the front frame 1 by a pin 63 to which is angularly movably attached a pivot arm 64 having one end pivotably connected by a first control rod 65 to the third upper pivot rod 21 and the other end pivotably connected by a second rod 66 to the side rod portion 42 of the U-shaped lower rod 33.

The brackets 52, 54 are in the shape of an L including outwardly extending members 67, 68, respectively, which serve as guides for the corresponding front and rear swing rods 19, 20 when the latter are pivotably moved downwardly as illustrated in FIG. 3.

When the crib is in use, sheets of net are attached over bottom, front and rear faces, and side faces of the crib, and a mattress is placed on the bottom in the crib. Since the crib is foldable longitudinally only and not in the transverse direction, sheets of hard material, instead of net, may be attached to the front and rear faces of the crib.

The manner in which the crib thus constructed is used will now be described.

For folding or collapsing the crib from the unfolded position as shown in FIG. 1, the lock knobs 61 are unlocked from the lock pins 41, 46, and then the grips 16, 24 on the first and third upper pivot rods 13, 21 are pushed upwardly to cause the first through fourth upper pivot rods 13, 14, 21 and 22 to be angularly displaced downwardly along the directions of the arrows 126, 127 into V-shaped configurations. At this time, the front and rear frames 1, 2 approach each other as the side rod portions 37, 42 and 38, 43 of the lower rods 33, 34 are turned in the directions of the arrows 173, 174 into inverted V-shaped contours. The first and second links 55, 56 and the third and fourth links 57, 58 are caused by the first through fourth connecting rods 47, 48, 49 and 50 to be angularly displaced into inverted V-shaped configurations. Continued movement of the front and rear frames 1, 2 toward each other in parallel relation causes the crib to be folded into the position as shown in FIG. 2. While the crib is being thus collapsed from the position of FIG. 1, the side rod portions 37, 42 of the front lower rod 33 are kept substantially parallel to the first and third links 55, 57, respectively, and similarly the side rod portions 38, 43 are kept substantially parallel to the second and fourth links 56, 58, respectively, as shown in FIG. 1. For the brevity of illustration, the first and second upper pivot rods 13, 14 and one of the lock knobs 61 are not shown in FIG. 2.

Folding of the crib can be facilitated by depressing the central rod portion 35 of the front U-shaped lower rod 33 while the grips 16, 24 on the first and second upper pivot rods 13, 21 are being pushed upwardly after the lock knobs 61 have been released from the lock pins 41, 46. More specificially, when the central rod portion 35 which projects outwardly from the front frame 1 is pressed downwardly, the second control rod 66 is pulled donwardly to enable the swing arm 64 to move the first control rod 65 upwardly, thereby assisting the third upper pivot rod 21 and hence the other upper pivot rods in angularly moving downwardly with a relatively small force exerted on the grips 16, 24.

When the baby is to be taken into or out of the crib as assembled as shown in FIG. 1, the latch bars 27, 28 are disengaged from the lock pins 29, 30, and the third and fourth upper pivot rods 21, 22 are forcibly pulled outwardly to displace the swing rods 19, 20 out of engagement with the retainers 25, 26 into engagement with the guides 67, 68, respectively, whereupon the swing rods 19, 20 are disposed parallel to lower portions of the side rods 4, 6 with the third and fourth upper pivot rods 21, 22 being in the lower position as shown in FIG. 3. Therefore, one side of the crib is now open allowing the baby to be carried into or out of the crib with utmost ease.

The crib as unfolded as shown in FIG. 1 is of quite a rugged construction offered by the interconnected assembly of the side rod portions 37, 38, 42 and 43 of the lower rods 33, 34, the side rods 3, 4, 5 and 6 of the front and rear frames 1, 2, the brackets 28, 40, 44 and 45, the links 55, 56, 57 and 58, and the intersecting connecting rods 47, 48, 49 and 50. The framework of the crib is particularly rendered strong by the combination of the side rod portions 37, 42 and the links 55, 57 and the combination of the side rod portions 38, 43 and the links 56, 58, which are substantially parallel to each other irrespective of whether the crib is folded or unfolded.

The crib can accordingly be folded easily and smoothly into the neatly collapsed position as shown in FIG. 2 simply by turning the grips 16, 24 on the first and third upper pivot rods 13, 21 upwardly to cause the front and rear frames 1, 2 to approach each other in substantially parallel relation.

Figure 4:
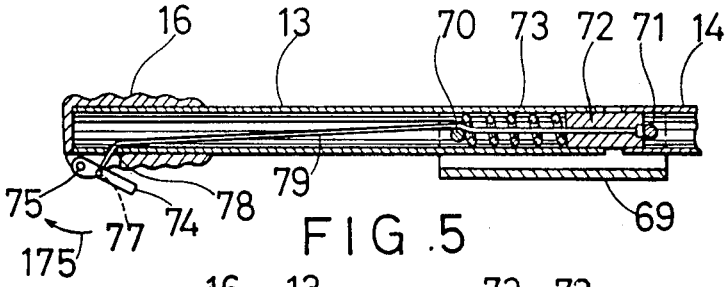
FIG. 4 is a cross-sectional view of a modified lock which can be incorporated in the crib illustrated in FIG. 1.
Figure 5:
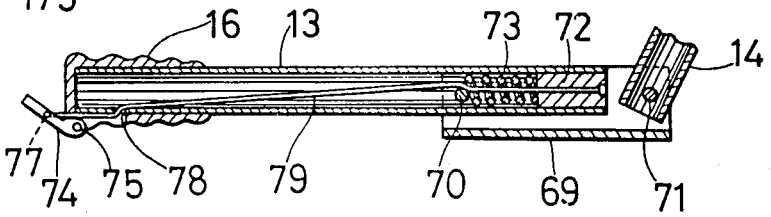
FIG. 5 is a cross-sectional view of the lock of FIG. 4 as it is unlocked.
Figure 6:
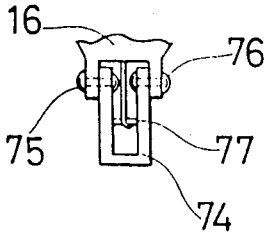
FIG. 6 is a rear elevational view of a lock bar of the lock shown in FIG. 4.

FIGS. 4 through 6 show a modified lock which can be incorporated in the crib shown in FIG. 1. A bracket 69 which is slightly different in structure from the bracket 15 of FIG. 1 is affixed to the first upper pivot rod 13 by a pin 70, with the second upper pivot rod 16 being angularly movably coupled to the bracket 69 by a pin 71. A locking body 72 is slidably inserted in confronting ends of the first and second upper pivot rods 13, 14 to maintain the latter substantially aligned with each other. The locking body 72 is normally urged into abutment against the pin 71 in the second upper pivot rod 14 by a spring 73 inserted between the pin 71 and the left end (as shown in FIG. 4) of the locking body 72. A U-shaped lock lever 74 is pivotably mounted on the grip 16 by pins 75, 76 and has a wire retainer 77 disposed in spaced relation to the pins 75, 76. A wire 79 is connected between the locking body 72 and the lock lever 74 and extends through the first upper pivot rod 13 and a hole 78 defined therein. Both or one of the first and third upper pivot rods 13, 21 may have such a lock. Where the lock of FIGS. 4 through 6 is incorporated in the crib, the lock knobs 61 may be dispensed with.

Operation of the lock thus constructed will be as follows: When the crib is unfolded as shown in FIG. 1, the locking body 72 and the lock lever 74 are in the position as shown in FIG. 4. Therefore, the locking body 72 is urged under the resiliency of the spring 73 to be placed in both the first and second upper pivot rods 13, 14 keeping the latter in coaxial alignment with each other. The first and second upper pivot rods 13, 14 are maintained in the aligned position even when subjected to severe external forces tending to bend the rods 13, 14, thus protecting the crib against being accidentally collapsed.

To collapse the crib, the grips 16, 24 are gripped and the lock lever 74 is turned in the direction of the arrow 175 (FIG. 4) to pull the wire 79 to the left causing the locking body 72 to move leftward while compressing the spring 73. When the lock lever 74 is turned to the position of FIG. 5, the end of the wire 79 which is attached to the lock lever 74 is positioned upwardly of the pivot pins 75, 76, whereupon the wire 79 is pulled to the right under the force of the spring 73 to lock the lock lever 74 in the position of FIG. 5. When the lock lever 74 is in this locked position, the locking body 72 is completely withdrawn from the second upper pivot rod 14. Therefore, the first and second upper pivot rods 13, 14 can now be folded into a V-shaped configuration in order to collapse the crib in the manner as described above.

With the lock lever 74 thus attached to the grip 16, the crib can be unlocked and folded quite easily in a single operation.

Figure 7:
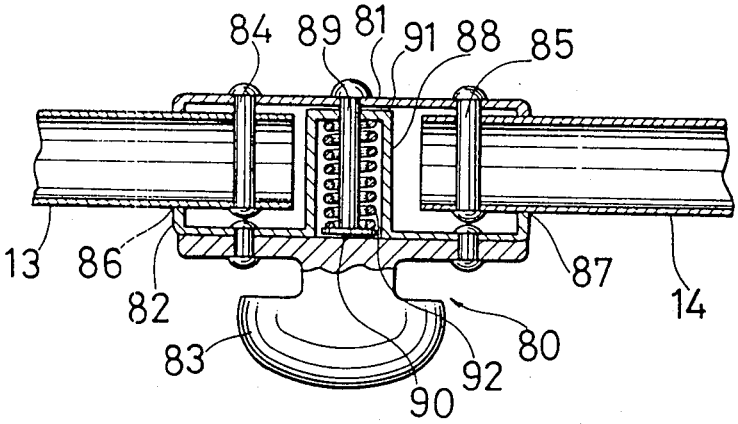
FIG. 7 is a cross-sectional view of another modified lock to be used in the crib of FIG. 1.
Figure 8:
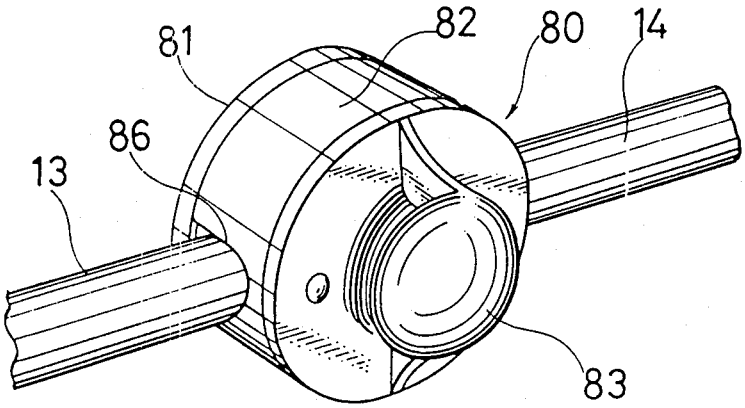
FIG. 8 is a perspective view of the lock illustrated in FIG. 7.

Another modified lock is illustrated in FIGS. 7 and 8. The first and second upper pivot rods 13, 14 are operatively interconnected by a connector 80 selectively for relative angular movement or axial alignment with each other. The connector 80 comprises a circular bottom plate 81, a cylindrical cover 82, and a knob 83 attached integrally to the cylindrical cover 82. The first and second upper pivot rods 13, 14 are angularly movably mounted on the bottom plate 81 by pins 84, 85, respectively. The cylindrical cover 82 has diametrically opposite recesses 86, 87 defined in side walls thereof for receiving therein the first and second upper pivot rods 13, 14, respectively. The cylindrical cover 82 also includes a central cylindrical spring holder 88 with a pin 89 affixed to the bottom plate 81 and extending centrally through the cylindrical spring holder 88. The cylindrical spring holder 88 includes a bottom 91, and the pin 89 has a retainer plate 90 mounted on an end thereof which is remote from the bottom 91. The spring holder 88 contains therein a spring 92 disposed between the bottom 91 and the spring retainer plate 90 and around the pin 89. The lock as shown in FIGS. 7 and 8 may also be mounted on the third and fourth upper pivot rods 21, 22. As an alternative, the lock may be installed on only one of the combinations of the first and second upper pivot rods and the third and fourth upper pivot rods.

The lock illustrated in FIGS. 7 and 8 will operate as follows: The parts shown in FIG. 7 are in the locked position in which the cover 82 is urged toward the bottom plate 81 under the resiliency of the spring 92 and the first and second upper pivot rods 13, 14 are received in the recesses 86, 87, respectively, in mutual alignment. In this position, the first and second upper pivot rods 13, 14 are kept from being relatively turned into any angularly spaced positions, and hence the crib is locked in the fully unfolded position.

When the crib is to be collapsed, the knob 83 is held by hand and pulled away from the bottom plate 81 under the force of the spring 92 for a distance greater than the outside diameter of the rods 13, 14 until the latter are placed out of the recesses 86, 87. Thus, the first and second upper pivot rods 13, 14 can freely move angularly relatively to each other and the bottom plate 81. The knob 83 as thus pulled is depressed to turn the rods 13, 14 downwardly into a V-shaped form. The crib can then be folded into the collapsed position in the manner as described above. The lock illustrated in FIGS. 7 and 8 is advantageous in that the lock can be released and the crib can be folded easily in a continuous operation simply by manipulating the knob 83. With the lock utilized, the first and third upper pivot rods 13, 21 need no projecting ends beyond the front frame 1 which would otherwise be necessary for folding the crib, and the crib with such no projecting ends is much safer and more sightly in appearance.

FIGS. 9 through 15 show a crib constructed in accordance with a second embodiment of the present invention. Like or corresponding parts in FIGS. 9 trough 15 are denoted by like or corresponding reference numerals in FIGS. 1 through 3. The crib has a rear frame 2 including a pair of side rods 5, 6 having feet 93, 94 on lower ends thereof, and a front frame 1 including a pair of side rods 3, 4. A pair of first and second upper pivot rods 95, **95*a* of a rectangular cross section each have one end pivotably connected respectively by brackets 96, 97 to upper end portions of the side rods 3, 5 of the front and rear frames 1, 2. To the other ends of the first and second upper pivot rods 95, 95*a*, there are secured by rivets 100, 101 a pair of brackets 98, 99, respectively, which are pivotably interconnected by a pivot pin 102**.

Figure 10:
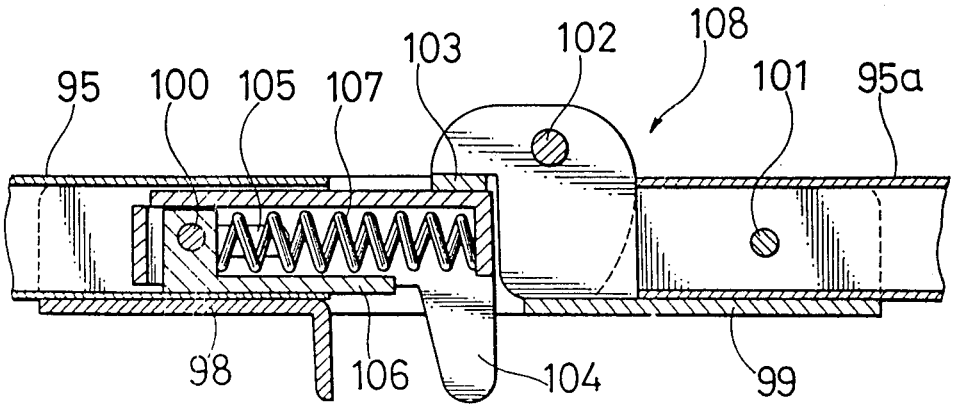
FIG. 10 is a cross-sectional view of a lock incorporated in the crib shown in FIG. 9.
Figure 11:
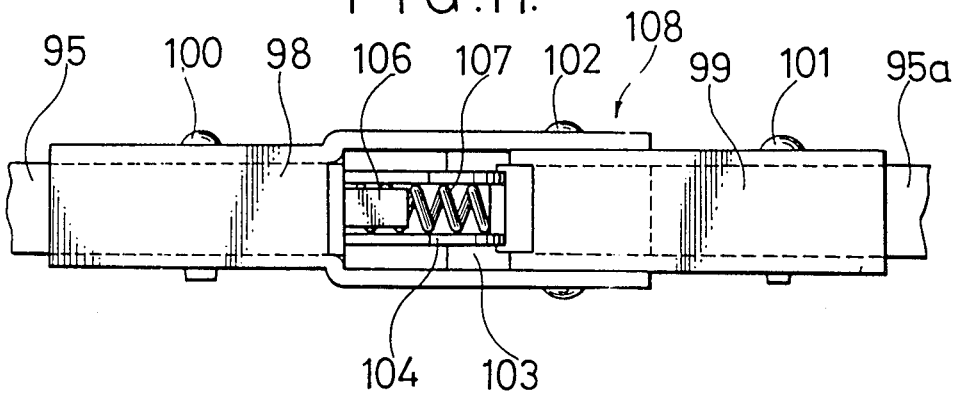
FIG. 11 is a bottom view of the lock illustrated in FIG. 9.

As shown in FIGS. 10 and 11, the bracket 99 includes a locking projection 103 located in front of the pivot pin 102. A lock lever 104 having an inverted U-shaped cross section is inserted in the other end of the first upper pivot rod 95 and engageable with the locking projection 103. The lock lever 104 has in side walls thereof guide slots 105 through which extends the rivet 100. The other end of the first upper pivot rod 95 receives therein an L-shaped spring retainer 106 affixed to the rivet 100. A spring 107 acts between the spring retainer 106 and the lock lever 104 for normally biasing the lock lever 104 into engagement with the locking projection 103 as shown in FIG. 10. The brackets 98, 99 and the lock lever 104 jointly constitute a lock 108 for locking the first and second upper pivot rods 95, 96 in axial alignment with each other.

Figure 9:
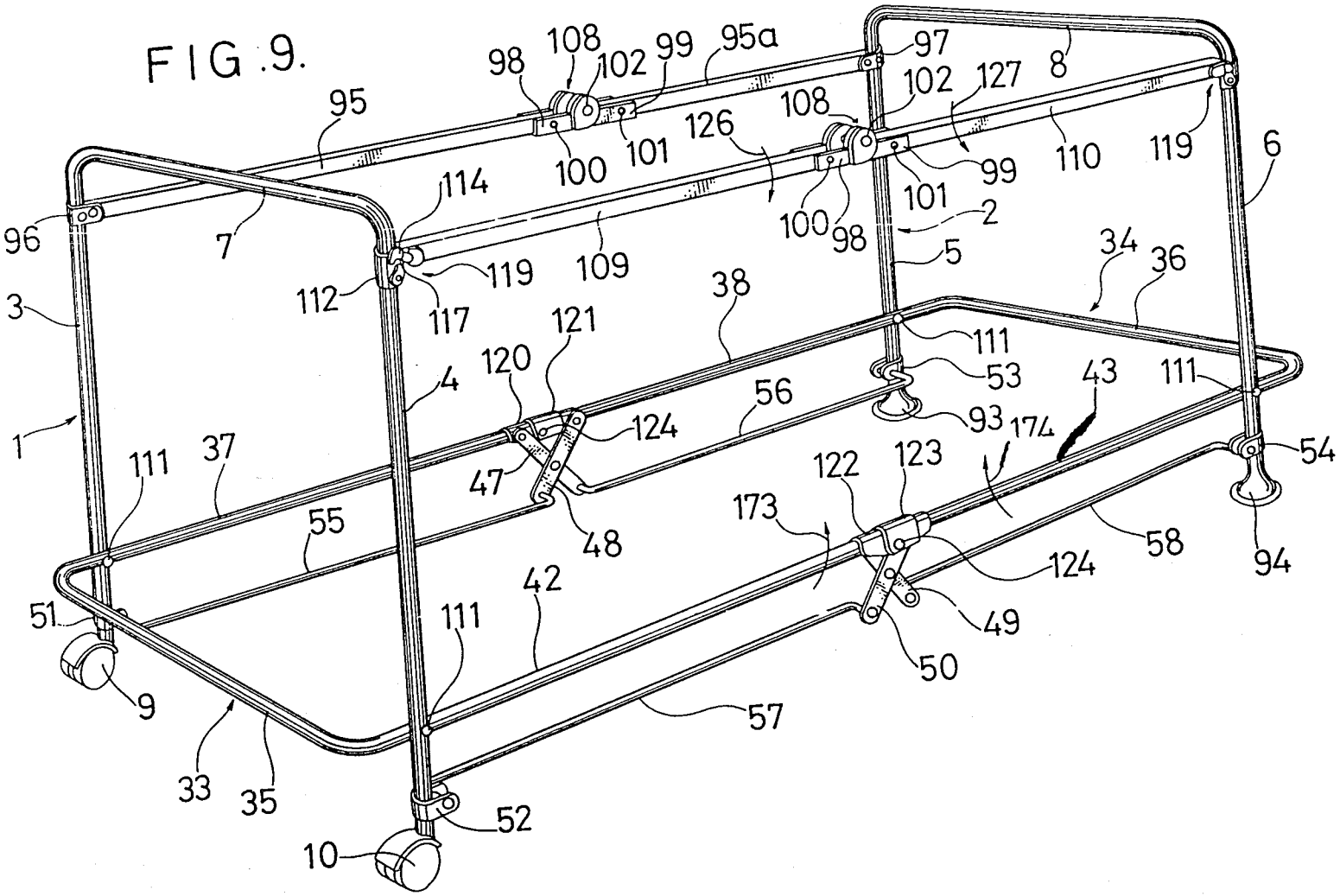
FIG. 9 is a perspective view of a crib according to a second embodiment of the present invention.
Figure 12:
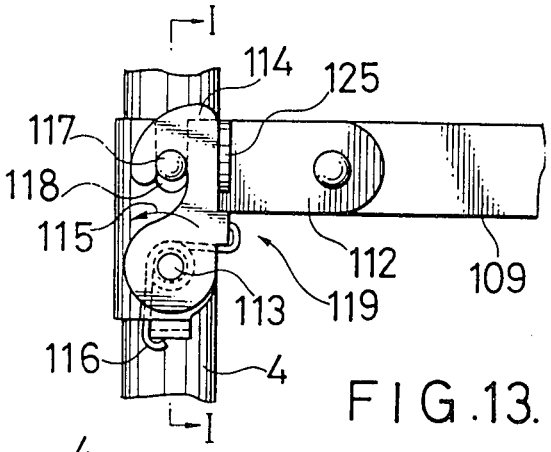
FIG. 12 is a side elevational view of a latch mechanism in the crib of FIG. 9.
Figure 13:
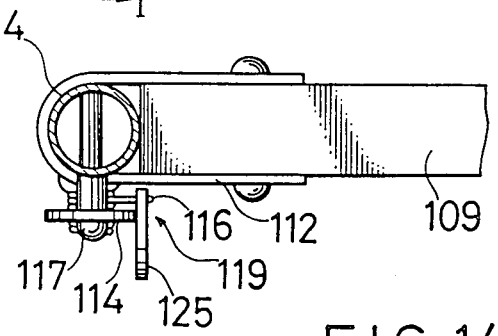
FIG. 13 is a bottom view partly in cross section of the latch mechanism shown in FIG. 12.
Figure 14:
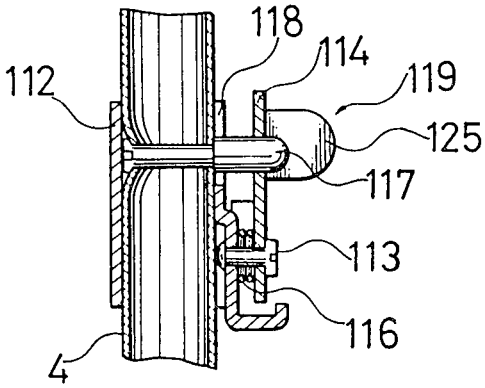
FIG. 14 is a cross-sectional view taken along line I—I of FIG. 12.
Figure 15:
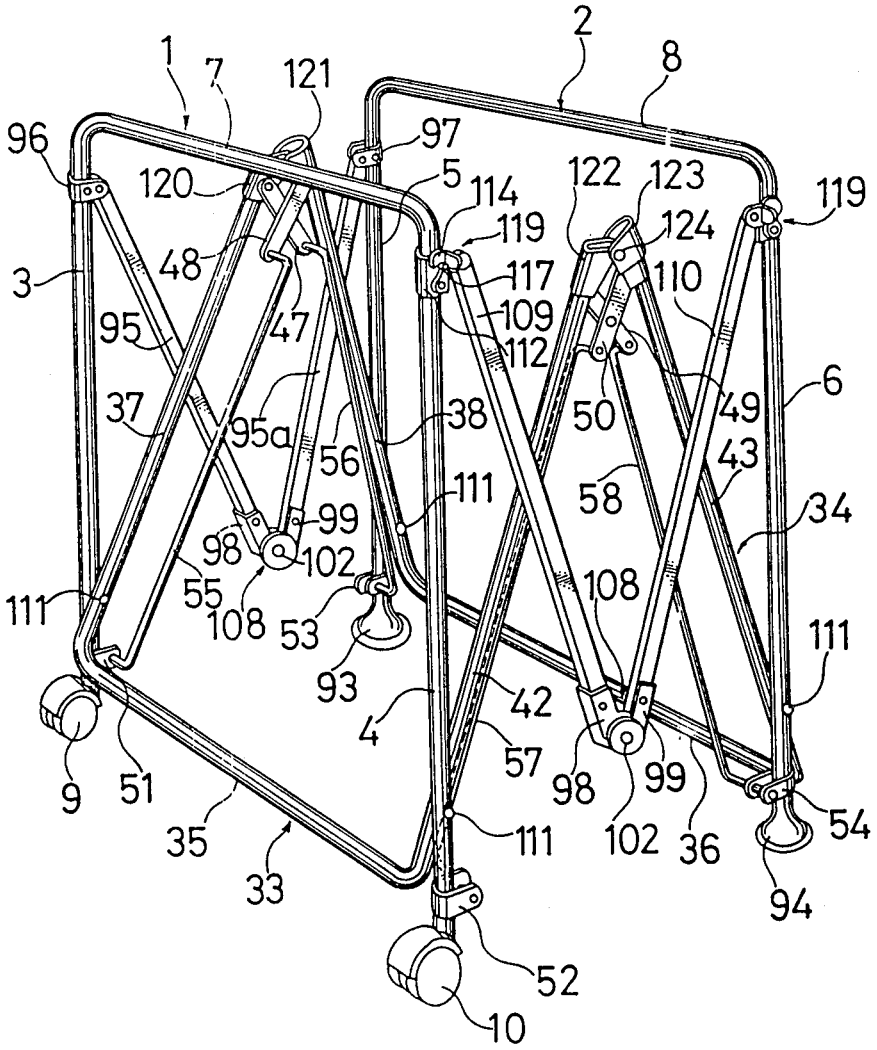
FIG. 15 is a perspective view of the crib of FIG. 9 as it is folded.

As illustrated in FIG. 9, the side rods 4, 6 have on their upper end portions a pair of slidable brackets 112, 112, respectively, to which are pivotably attached ends of a pair of third and fourth upper pivot rods 109, 110 having rectangular cross section. A locking hood 114 is angularly movably mounted on each of the brackets 112 by a pivot pin 113, as shown in FIGS. 12 through 14, and is normally urged to turn in the direction of the arrow 115 (FIG. 12) under the force of a torsion spring 116 disposed around the pivot pin 113. Each of the side rods 4, 6 has a lock pin 117 secured to an upper end portion thereof and positioned in a guide slot 118 defined in the bracket 112 for engagement with the locking hook 114. The bracket 112, the locking hook 114, and the pin 117 jointly constitute a locking mechanism 119 for locking each of the third and fourth upper rods 109, 110 on the upper end portion of one of the side rods 4, 6 of the front and rear frames 1, 2. As with the first and second upper pivot rods 95, 95*a*, the third and fourth upper pivot rods 109, 110 are pivotably interconnected by a pair of brackets 98, 99 that are angularly movably coupled by a pivot pin 102, the brackets 98, 99 having a lock 108 for releasably locking the brackets 98, 99.

The crib also has a pair of U-shaped lower rods 33, 34 including side rod portions 37, 38 and 42, 43, respectively, which have on their distal ends first through fourth brackets 120, 121, 122 and 123. The first and second brackets 120, 121, and the third and fourth brackets 122, 123 are pivotably interconnected by a pair of pivot pins 124, 124, respectively. To the first through fourth brackets 120, 121, 122 and 123 are pivotably connected ends of first through fourth connecting rods 47, 48, 49 and 50, which are operatively connected to the side rods 3, 4, 5 and 6 by links 55, 56, 57 and 58, respectively.

Operation of the crib according to the second embodiment will now be described. The crib is shown in FIG. 9 as being unfolded with the locking hooks 114 of the locking mechanisms 119 being locked on the lock pins 117. In this locked position, the third and fourth upper pivot rods 109, 110 are attached to the upper end portions of the side rods 4, 6 of the front and rear frames 1, 2. The first and second upper pivot rods 95, 95*a*, and the third and fourth upper pivot rods 109, 110 are axially aligned with each other by the locks 108, 108 in each of which the lock lever 104 is biased by the spring 107 to move toward the second or fourth upper pivot rod 95*a*, 110 into engagement with the locking projection 103, locking the upper pivot rods 95, 95*a*, and 109, 110 in mutual alignment against being angularly displaced relatively to each other. The brackets 120, 121 and 122, 123 on the lower rods 33, 34 are interengaged in partly superimposed relation to retain the side rod portions 37, 38 and 42, 43 in axial alignment with each other.

For folding the crib from the position of FIG. 9, each of the lock levers 104 is pulled into a corresponding one of the first and third upper pivot rods 95, 109 against the resiliency of the spring 107. The lock lever 107 is then retracted out of engagement with the locking projection 103, whereupon the first and second upper pivot rods 95, 95*a*, and a third and fourth upper pivot rodfs 109, 110 become freely pivotable. The pivot rods 95, 95*a* and 109, 110 are now caused by gravity to turn slightly downwardly in the directions of the arrows 126, 127. Once the rods 95, 95*a*, 109, 110 are angularly moved downwardly, there is no danger for them to be locked again even when the lock lever 104 is released of a pull and projects under the force of the spring 107. Then, the crib can be folded into the collapsed position shown in FIG. 15 in the same manner as described above with reference to the crib according to the first embodiment.

When the baby is to be placed into or out of the crib as assembled in FIG. 9, the locking hooks 114 of the front and rear locking mechanisms 119 are turned in directions opposite to the directions 115 by fingering projections 125 on the locking hooks 114 until the locking hooks 114 are disengaged from the lock pins 117. Then, the third and fourth upper pivot rods 109, 110 are caused to slide down the side rods 4, 6. With the pivot rods 109, 110 being thus lowered, the baby can easily be carried into or out of the crib. Accordingly, by simply unlocking and sliding down the third and fourth upper pivot rods 109, 110, one can easily put the baby into or out of the crib without being disturbed by any parts of the crib.

Figure 18:
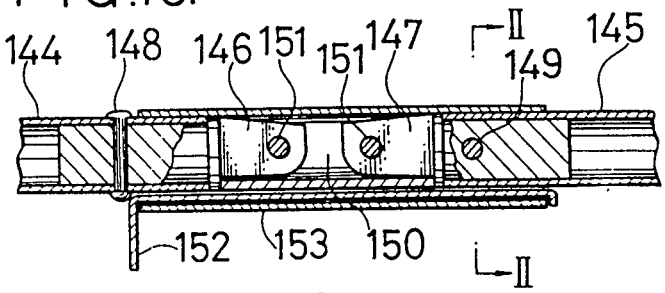
FIG. 18 is a cross-sectional view of the lock illustrated in FIG. 17.
Figure 19:
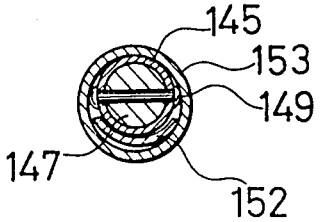
FIG. 19 is a cross-sectional view taken along line II—II of FIG. 18.
Figure 20:
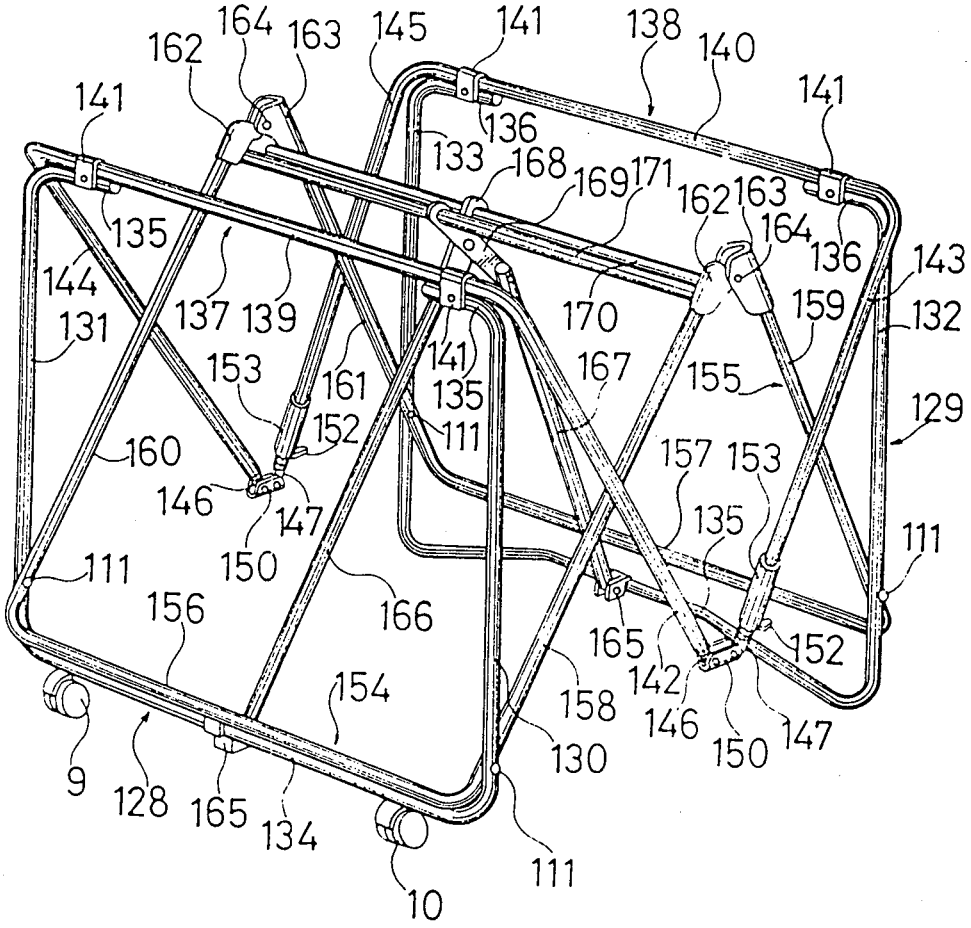
FIG. 20 is a perspective view of the crib of FIG. 16 as it is collapsed.

FIGS. 16 through 20 show a crib according to a third embodiment of the present invention. The crib includes a pair of front and rear U-shaped frames 128, 129 composed of side rods 130, 131 and 132, 133, respectively, and lower rods 134, 135, respectively. A pair of castors 9, 10 are attached to the lower rod 134 of the front frame 128. The side rods 130, 131 or 132, 133 of each of the front and rear frames 128, 129 include a pair of upper bent end portions 135, 136 on which are pivotably mounted central rod portions 139, 140 respectively of a pair of front and rear U-shaped upper frames 137, 138 by means of a pair of brackets 141, 141. The front and rear U-shaped upper frames 137, 138 include side rod portions or upper pivot rod portions 142, 143 and 144, 145 having in their confronting ends pipe end inserts 146, 147 (FIGS. 17 and 18) which have flat ends and are secured to the upper pivot rod portions 142, 143 and 144, 145. The pipe end inserts 146, 147 are pivotably attached at their flat ends to a U-shaped bracket 150 by a pair of rivets 151, 151, respectively. Thus, the upper pivot rod portions 142, 143 and 144, 145 of the upper frames 137, 138 are interconnected for relative angular movement. As best shown in FIG. 18, a cylindrical lock 153 is fitted over the bracket 150 and the confronting ends of the upper pivot rod portions 142, 143 or 144, 145, there being an L-shaped stop 152 being fixedly disposed in the cylindrical lock 153. The cylindrical lock 153 serves to lock the upper pivot rod portions 142, 143 or 144, 145 to keep the latter mutually axially aligned when fitted over both the ends therof.

A pair of front and rear U-shaped lower frames 154, 155 are pivotably mounted by pins 111 on lower end portions of the side rods 130, 131 and 132, 133 of the front and rear frames 128, 129. The front and rear lower frames 154, 155 include central rod portions 156, 157, respectively, projecting outwardly beyond the front and rear frames 128, 129, and side rod portions or lower pivot portions 158, 160 and 159, 161, respectively, having on their distal ends front and rear brackets 162, 163 which are pivotably interconnected by a pivot pin 164.

A pair of front and rear longitudinal links 166, 167 are pivotably connected at ends thereof to the centers of the lower rod portions 134, 135 of the front and rear frames 128, 129 by means of brackets 165. The front and rear links 166, 167 have other ends pivotably coupled with ends of a pair of first and second connecting rods or bars 168, 169 that are pivotably interconnected in a cross-cross relation. The other ends of the first and second connecting bars 168, 169 have holes through which extend first and second transverse links 170, 171, respectively, having ends fixed to the brackets 163, 162 on the lower frames 155, 154.

The crib according to the third embodiment will operate as follows: The crib is shown unfolded in FIG. 16. In this unfolded position, the stops 152 in the cylindrical locks 153 are held in abutment against the heads of the rivets 148 with the cylindrical locks 153 being disposed over the ends of the upper pivot rod portions 142, 143 and 144, 145, which are therefore locked in mutual axial alignment with each other. The brackets 162, 163 on the lower frames 154, 155 are locked against each other in partly superimposed relation, thus keeping the lower pivot rod portions 158, 159 and 160, 161 mutually aligned axially. The longitudinal links 166, 167 extend substantailly parallel to the lower pivot rod portions 158, 159 and 160, 161.

When the crib is to be collapsed from the folded position, the cylindrical locks 153, 153 are held by hand and slid in the direction of the arrow 172 (FIG. 16) until the cylindrical locks 153, 153 are moved away from the rod portions 142, 144 of the front frame 137 onto the rod portions 143, 145 of the rear frame 138. The rod portions 142, 143 and 144, 145 are therefore unlocked and become slightly angularly displaced downwardly due to gravity in the directions of the arrows 126, 127. Then, the crib can be collapsed into the folded position shown in FIG. 20 in the same manner as described with respect to the crib according to the first embodiment.

Figure 16:
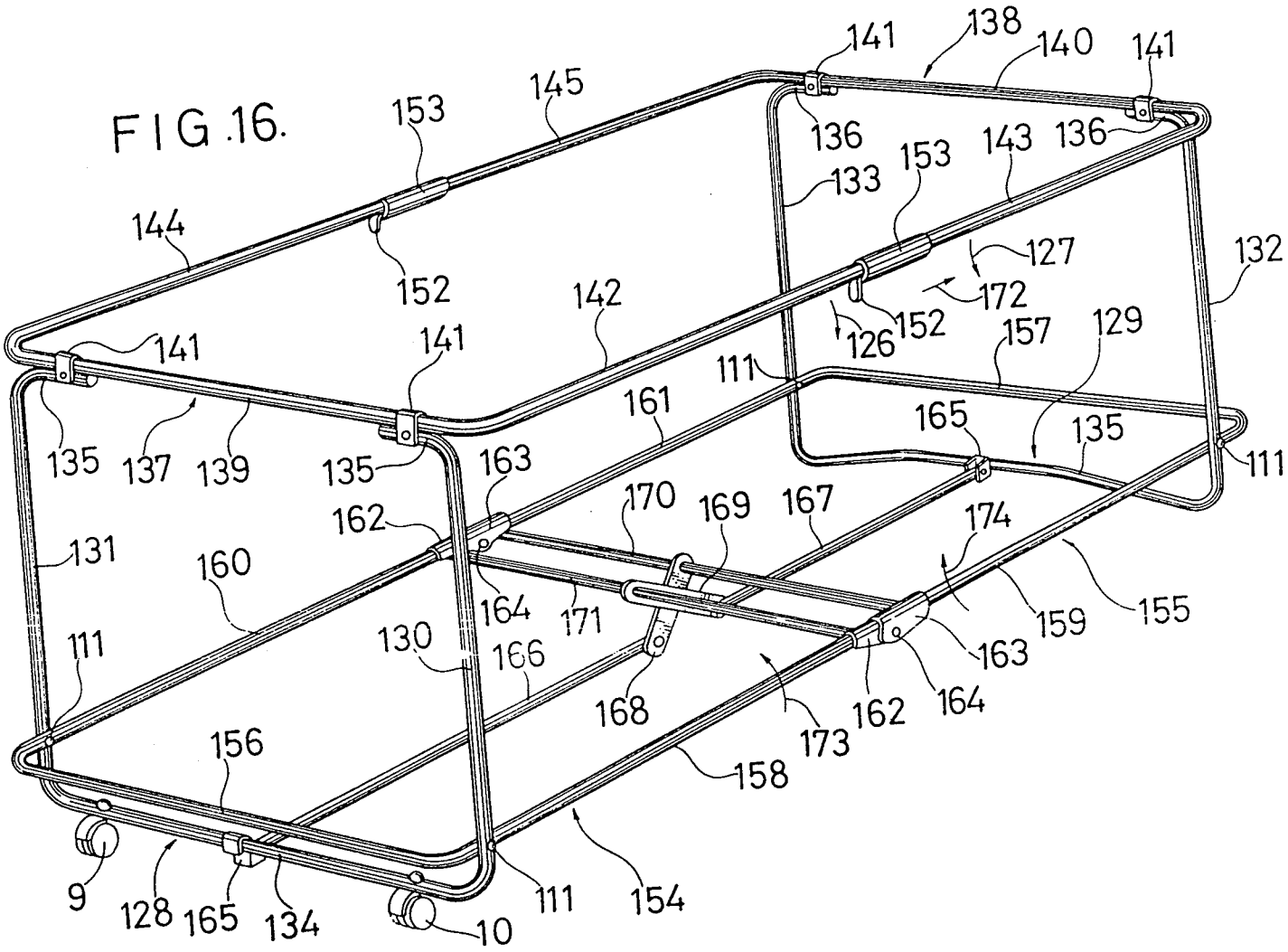
FIG. 16 is a perspective view of a crib in accordance with a third embodiment of the present invention.
Figure 17:
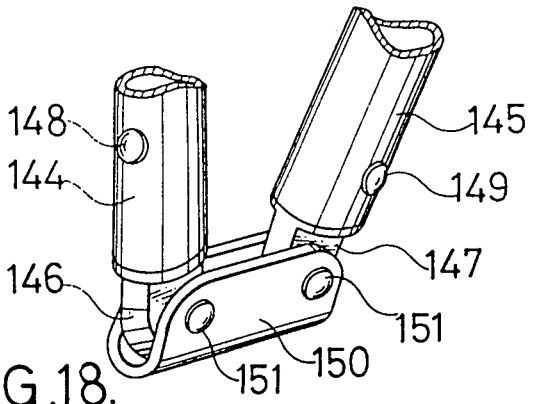
FIG. 17 is a perspective view of a lock incorporated in the crib shown in FIG. 16.

With the crib illustrated in FIG. 16, only one set of connecting bars 168, 169 is required which are coupled to the longitudinal links 166, 167 connected by the brackets 165, 165 to the centers of the lower rod portions 134, 135 of the front and rear frames 128, 129, and which are also coupled to the transverse links 170, 171 connected to the brackets 162, 163 on the front and rear lower frames 154, 155. Accordingly, the crib of the third embodiment is relatively simple in construction. Since the U-shaped frames 128, 129, 137, 138, 154 and 155 are employed in making up the crib framework, there are a relatively small number of parts needed. The crib can thus be fabricated easily in a realtively simple procedure.

The cylindrical locks 153, 153 are functionally and structurally simple in that they can lock the upper pivot rod portions 142, 143 and 144, 145 in axial alignment simply by being fitted over the confronting ends thereof.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A crib comprising:

a front and rear inverted U-shaped frames each including a pair of first and second side rod portions and an upper rod portion; and means for moving said spaced frames together while simultaneously maintaining said frames parallel to one another, said moving and maintaining means comprising:

a pair of first and second upper pivot rods having ends pivotably connected to upper end portions of said first side rod portions of said front and rear frames and other ends pivotably connected to each other, a pair of third and fourth upper pivot rods having ends pivotably connectable to upper end portions of said second side rod portions of said front and rear frames and other ends pivotably connected to each other, a pair of front and rear U-shaped lower rods each including a pair of first and second side rod portions and a central rod portion extending therebetween, said front and rear lower rods being pivotably connected at portions thereof between said first and second side rod portions and central rod portion thereof to lower end portions of said first and second side rod portions of said front and rear frames, a pair of first and second brackets fixedly mounted on distal ends of said first side rod portions of said front and rear lower rods and pivotably connected to each other, a pair of third and fourth brackets fixedly mounted on distal ends of said second side rod portions of said front and rear lower rods and pivotably connected to each other, first, second, third and fourth connecting bars having ends pivotably connected to said first, second, third and fourth brackets, respectively, said first and second connecting bars being pivotably coupled to each other, and said third and fourth connecting bars being pivotably coupled to each other, a pair of first and second links pivotably connected between the lower end portions of said first side rod portions of said front and rear frames and said second and first connecting bars, respectively, a pair of third and fourth links pivotably connected between the lower end portions of said second side rod portions of said front and rear frames and said fourth and third connecting bars, respectively, and means for locking said first and second upper pivot rods, said third and fourth upper pivot rods, or said first and second side rod portions of said front and rear lower rods in mutual axial alignment.

2. A crib according to claim 1, including a pair of swing rods pivotably connected centrally to said second side rod portions of said front and rear frames and pivotably movable in planes in which said front and rear frames lie, said third and fourth upper pivot rods being pivotably connected to distal ends of said swing rods, said third and fourth upper pivot rods being pivotably connected to the upper end portions of said second side rod portions of said front and rear frames when said swing rods are retained on and along upper half portions of said second side rod portions of said front and rear frames.

3. A crib according to claim 1 or 2, wherein said means comprises a pivot pin by which said first and second brackets or said third and fourth brackets are pivotably connected to each other, a pivot rod by which said first and second connecting bars or said third and fourth connecting bars are pivotably connected to each other, and a locking knob fixed to said pivot rod for lockingly engaging said pivot pin.

4. A crib according to claim 1 or 2, wherein said means comprises a locking body normally inserted in said first and second upper pivot rod portions or third and fourth upper pivot rod portions, a spring for normally urging said locking body to be placed in both said first and second or third and fourth upper pivot rod portions, a grip mounted on an end of one of said first and second upper pivot rod portions or one of said third and fourth upper pivot rod portions, a lock lever pivotably attached to said grip, said one of said first and second or said third and fourth upper pivot rod portions having a hole, and a wire connected between said locking body and said lock lever and extending through said hole for pulling said locking body out of the other of said first and second or third and fourth upper pivot rod portions against the force of said spring when said lock lever is turned.

5. A crib according to claim 1 or 2, wherein said means comprises a bottom plate on which said other ends of said first and second or third and fourth upper pivot rod portions are pivotably mounted, a cylindrical cover mounted on said bottom plate and having a pair of recesses receptive of said first and second or third and fourth upper pivot rod portions, a spring acting between said bottom plate and said cylindrical cover for normally urging the latter toward said bottom plate to receive said first and second or third and fourth upper pivot portions lockingly in said recesses, respectively, and a knob affixed to said cylindrical cover for displacing said cylindrical cover away from said bottom plate against the force of said spring to unlock said first and second or third and fourth upper pivot rod portions.

6. A crib according to claim 1 or 2, wherein said central rod portions of said lower rod projects outwardly beyond said front and rear frames, further including a pivot arm pivotably mounted centrally on one of said second side rod portions of said front and rear frames, a first control rod pivotably connected between one end of said pivot arm and one of said third and fourth upper pivot rods which is pivotably connectable to said one of said second side rod portions, and a second control rod pivotably connected between the other end of said pivot arm and one of said third and fourth side rod portions of said front and rear lower rods.

7. A crib according to claim 1, wherein said third and fourth upper pivot rods are slidably and pivotably mounted on said second side rod portions of said front and rear frames, further including a latch mechanism for locking each of said third and fourth upper pivot rods on the upper end portions of said second side rod portions of said front and rear frames.

8. A crib according to claim 7, wherein said latch mechanism comprises a lock pin mounted on each of said second side rod portions of said front and rear frames, and a locking hook pivotably mounted on each of said one ends of said third and fourth upper pivot rods for lockingly engaging said lock pin.

9. A crib according to claim 7 or 8, wherein said means comprises a locking projection mounted on said other end of said second upper pivot rod and disposed in front of a position in which said first and second upper pivot rods are pivotably interconnected, a lock lever retractably mounted in said other end of said first upper pivot rod and movable between a first position in which said lock lever projects into engagement with said locking projection to prevent said first and second upper pivot rods from being relatively angularly moved when they are held in mutual axial alignment and a second position in which said lock lever is withdrawn into said first upper pivot rod to allow said first and second upper pivot rods to be relatively angularly moved, and a spring disposed in said first upper pivot rod for normally urging said lock lever toward said first position.

10. A collapsible crib, comprising:

a pair of front and rear spaced, parallel U-shaped frames each having a pair of first and second side rod portions and a lower rod portion extending therebetween; and means for moving said spaced frames together to collapse said crib while simultaneously maintaining said frames parallel to one another, said moving and maintaining means comprising a pair of front and rear upper rod portions mounted at ends thereof on upper end portions of said first and second side rod portions of said front and rear frames first front upper and lower, and rear upper and lower rod portions pivotably mounted at ends thereof on upper and lower end portions of said first side rod portions of said front and rear frames and having other ends pivotably interconnected, second front upper and lower, and rear upper and lower rod portions pivotably mounted at ends thereof on upper and lower end portions of said second side rod portions of said front and rear frames and having other ends pivotably interconnected, a pair of front and rear longitudinal links having ends pivotably connected centrally to said lower rod portions of said front and rear frames, a pair of first and second connecting bars pivotably interconnected in a crisscross relation and having ends pivotably coupled to the other ends of said front and rear longitudinal links, a pair of first and second transverse links pivotably connecting the other ends of said connecting bars respectively to the other ends of said first and second rear lower rod portions and said first and second front lower rod portions, and means for locking said first or second, upper or lower front and rear rod portions in mutual axial alignment.

11. A crib according to claim 10, wherein said locking means comprises a cylindrical body normally fitted over both of said first or second, upper or lower front and rear rod portions for locking them, said cylindrical body being movable onto one of said front and rear rod portions for unlocking said front rod portion from said rear rod portion.

* * * * *